United States Patent [19]

Matsubayashi et al.

[11] 4,296,182

[45] Oct. 20, 1981

[54] CAN COMPOSED OF ELECTROLYTICALLY CHROMATED STEEL

[75] Inventors: Hiroshi Matsubayashi, Kamakura; Michiko Tsurumaru, Tokyo; Makoto Horiguchi, Fujisawa; Hiroshi Ueno, Yokosuka; Yoichi Kitamura, Yokohama, all of Japan

[73] Assignee: Toyo Seikan Kaisha Limited, Tokyo, Japan

[21] Appl. No.: 35,333

[22] Filed: May 1, 1979

[30] Foreign Application Priority Data

May 8, 1978 [JP] Japan ..... 53-53819
Dec. 13, 1978 [JP] Japan ..... 53-153202

[51] Int. Cl.[3] ..... B65D 7/00; C25D 11/38; C23C 17/00; B32B 15/08

[52] U.S. Cl. ..... 428/629; 148/6.16; 148/6.2; 148/31.5; 204/14 R; 204/41; 204/51; 220/455; 428/35; 428/418; 428/460; 428/469

[58] Field of Search ..... 148/6.16, 6.2, 31.5; 204/14 R, 41, 51; 428/416, 418, 460, 469, 35, 629; 220/455

[56] References Cited

U.S. PATENT DOCUMENTS

| | | | |
|---|---|---|---|
| 3,157,585 | 11/1964 | Durham | 204/41 |
| 3,421,986 | 1/1969 | Ruff et al. | 204/41 X |
| 3,578,509 | 5/1971 | Palm et al. | 148/31.5 X |
| 3,716,400 | 2/1973 | Tryzna et al. | 428/418 X |
| 3,717,509 | 2/1973 | Palm et al. | 148/6.16 X |
| 3,799,814 | 3/1974 | Yamagishi et al. | 428/629 X |
| 3,826,628 | 7/1974 | Addinall et al. | 428/629 X |
| 3,860,398 | 1/1975 | Tsurumaru et al. | 428/629 X |
| 3,936,342 | 2/1976 | Matsubara et al. | 428/460 X |
| 4,003,760 | 1/1977 | Labenski et al. | 148/6.2 |
| 4,006,041 | 2/1977 | Fabregas et al. | 148/6.16 |
| 4,025,692 | 5/1977 | Yamagishi et al. | 148/6.16 X |
| 4,157,924 | 6/1979 | Elms et al. | 148/6.2 |
| 4,177,323 | 12/1979 | Obi et al. | 428/416 X |

FOREIGN PATENT DOCUMENTS

| | | |
|---|---|---|
| 36-15155 | 9/1961 | Japan . |
| 43-2768 | 1/1968 | Japan . |
| 43-5532 | 2/1968 | Japan . |

*Primary Examiner*—George F. Lesmes
*Assistant Examiner*—Alexander S. Thomas
*Attorney, Agent, or Firm*—Wenderoth, Lind & Ponack

[57] ABSTRACT

A can at least a part of which is made of an electrolytically chromated steel sheet, said steel sheet having such a surface that when it is degreased in acetone for 1 minute and analyzed by an Auger electron spectrometer at an incident electron accelerating voltage of 3 KeV, a modulation voltage of 3 V, a modulation frequency of 12 to 20 KHz and a degree of vacuum of at least $6\times10^{-8}$ torr, the ratio of the peak-peak distance ($O_{P\text{-}P}$) of $KL_{2.3}L_{2.3}$ of oxygen to the base-peak distance ($Cr_{B\text{-}P}$) of $L_3M_{2.3}M_{4.5}$ of chromium in the resulting Auger electron spectrum satisfies the following relation:

$$6.5 \geqq (O_{P\text{-}P})/(Cr_{B\text{-}P}) \geqq 1.5.$$

4 Claims, 1 Drawing Figure

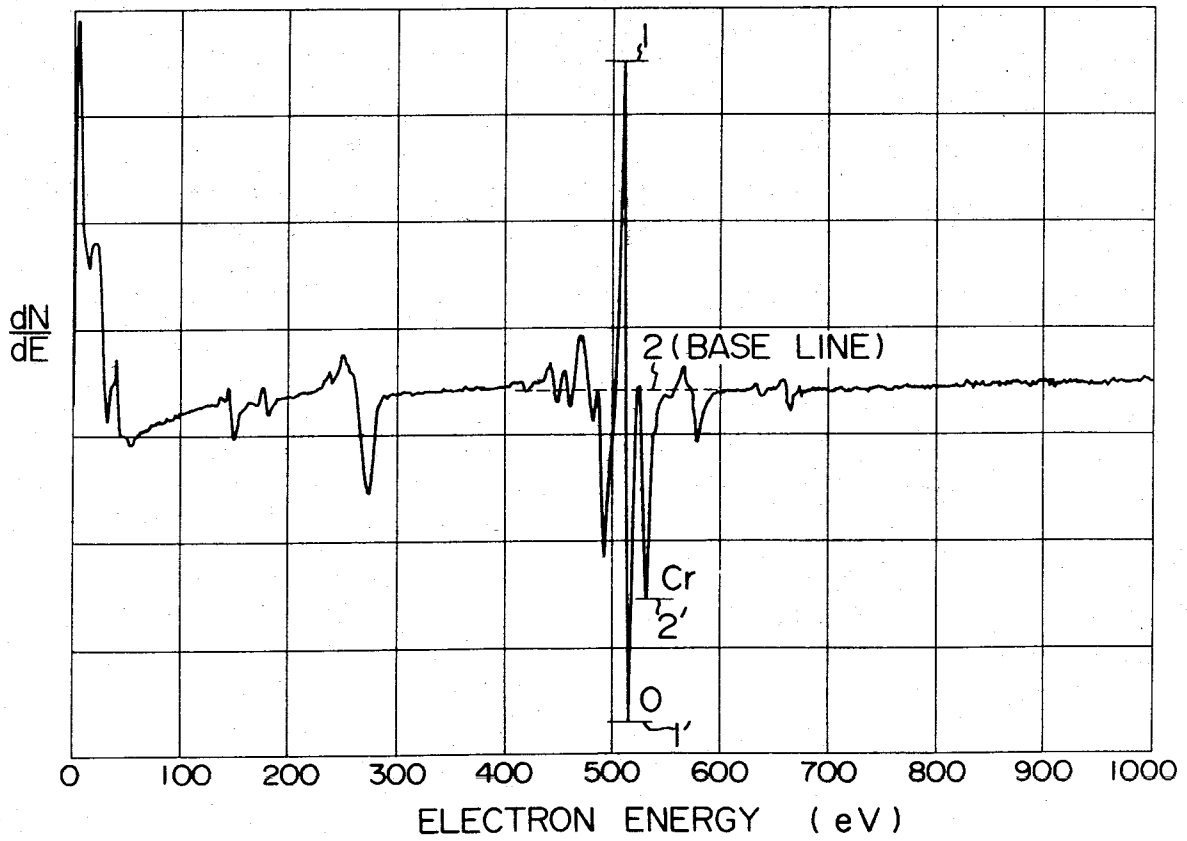
dN/dE
0
100
200
300
400
500
600
700
800
900
1000
ELECTRON ENERGY (eV)
1
2 (BASE LINE)
Cr
2'
O
1'

CAN COMPOSED OF ELECTROLYTICALLY CHROMATED STEEL

This invention relates to a can composed of a steel sheet having a chromium coating on its surface, and specifically to a can composed of an electrolytically chromated steel sheet having superior resistance to heat sterilization and superior resistance to hot water deterioration.

More specifically, this invention pertains to a cemented can for retorting which is to be heat-sterilized after filling an article therein, particularly an electrolytically chromated steel sheet (tin-free steel).

In recent years, quantities of steel sheets having a chromium coating formed by electrolytic treatment in chromic acid solution, known as TFS sheets, have been used in place of tin plate as a can stock which requires corrosion resistance.

Cans produced from TFS, above all TFS cans coated with organic coating, are considered to be unsuitable for use in canned foods which require heat sterilization, for example cemented cans for retorting. Since cemented cans for retorting are exposed to a high temperature of, say, more than 110° C. at the time of heat sterilization, the bonded portion is required to have high resistance to deterioration by high temperatures.

Specifically, cemented cans for retorting are required to have the following properties at the interface between the TFS and the organic coating or adhesive, in contrast to cemented cans for carbonated drinks or hot-filled juices.

(1) The bonded portion should not be peeled off during the heat sterilizing step.

(2) Deterioration of the bonded portion with time after the heat sterilizing step should be small.

(3) The degree of vacuum within the can should not be decreased during long-term storage after heat sterilization.

(4) During storage after heat sterilization, corrosion by the contents of the can and the lifting of the coating should not occur at the processed portion, especially at the double-seamed portion.

(5) Deterioration in bonding should be small at the double-seamed portion during storage after heat sterilization.

Conventional TFS cans, when heat-sterilized in a retort after filling a product decrease in bond strength between the organic coating on the inside surface of the can and TFS. Thus, the coating peels off and rust or perforations occur, and the problem of dissolving of iron arises. Particularly, in cemented cans, the bonded portion of the can body may undergo breakage as a result of a decrease in bond strength between the enamel and TFS during heat sterilization.

Accordingly, tin plate soldered side seam cans are mainly used for retorting, and cemented cans for retorting made of electrolytically chromated steel sheet are not produced for the reason that the bonded portion does not meet the aforesaid requirements.

However, since electrolytically chromated steel sheets are much cheaper than tin plate, it is desired to produce cemented cans for retorting from these steel sheets.

It is an object of this invention to provide TFS cans having superior adhesion to organic coatings, especially under heating conditions.

Another object of this invention is to provide a cemented can for retorting having resistance to deterioration at high temperatures and made of an electrolytically chromated steel sheet.

The present inventors have now found that an electrolytically chromated steel sheet having a specified relation between an oxygen peak and a chromium peak in Auger electron spectroscopy has very good adhesion to organic coating, and gives can bodies which have resistance to sterilization at high temperatures.

According to this invention, there is provided a can composed at least partly of an electrolytically chromated steel sheet, said steel sheet having such a surface that when it is degreased in acetone for 1 minute and analyzed by an Auger electron spectrometer at an incident electron accelerating voltage of 3 KeV, a modulation voltage of 3 V, a modulation frequency of 12 to 20 KHz and a degree of vacuum of at least $6\times10^{-8}$ torr, the ratio of the peak-peak distance ($O_{P\text{-}P}$) of $KL_{2.3}L_{2.3}$ of oxygen to the base-peak distance ($Cr_{B\text{-}P}$) of $L_3M_{2.3}M_{4.5}$ of chromium in the resulting Auger electron spectrum satisfies the following relation:

$$6.5 \geqq (O_{P\text{-}P})/(Cr_{B\text{-}P}) \geqq 1.5.$$

The electrolytically chromated steel sheet has a chromium-containing layer on its surface. The coated layer usually consists of a layer of metallic chromium and a layer of chromium oxide. The thickness of the metallic chromium layer is 20 to 300 mg/m$^2$, preferably 30 to 150 mg/m$^2$, and the thickness of the chromium oxide layer is 5 to 50 mg/m$^2$, preferably 7 to 30 mg/m$^2$, as the amount of chromium.

The chromium coating in accordance with this invention is characterised over conventional TFS in that when a sample obtained by degreasing the chromium-coated steel sheet in acetone for 1 minute is subjected to Auger electron spectroscopy at an incident electron accelerating voltage of 3 KeV, a modulation voltage of 3 V, a modulation frequency of 12 to 20 KHz and a degree of vacuum of at least $6\times10^{-8}$, the ratio of the peak-peak distance ($O_{P\text{-}P}$) of $KL_{2.3}L_{2.3}$ of oxygen to the base-peak distance ($Cr_{B\text{-}P}$) of $L_3M_{2.3}M_{4.5}$ of chromium, i.e. $(O_{P\text{-}P})/(Cr_{B\text{-}P})$, in the resulting spectral chart is from 1.5 to 6.5, preferably from 2.0 to 6.0.

The FIGURE is an Auger electron spectrum chart of the electrolytically chromated steel obtained in Example 1 to be given hereinbelow. In the drawing, the distance between points 1 and 1' is the peak-peak distance of $KL_{2.3}L_{2.3}$ of oxygen, and the distance between a base line 2 shown by broken line and a base line 2' is the base-peak distance of $L_3M_{2.3}M_{4.5}$ of chromium. When the $(O_{P\text{-}P})/(Cr_{B\text{-}P})$ ratio is less than 1.5, the initial adhesion strength of the chromium-containing layer to enamel is low, and the adhesion strength decreases markedly during heat sterilization or with the lapse of time. On the other hand, when the $(O_{P\text{-}P})/(Cr_{B\text{-}P})$ ratio is above 6, the initial adhesion strength is high, but the adhesion strength to enamel decreases during heat sterilization or with the lapse of time, and the peeling of the coated layer inside the seamed portion increases.

The electrolytically chromated steel sheet used for the can body of this invention can be produced by various methods. Some examples are given below without any intention of limiting the invention thereto.

(1) The surface of a steel sheet is degreased, and washed with an acid and then water in a customary manner, and then treated non-electrolytically in a 0.15–0.45 g/l aqueous solution of chromic anhydride ($CrO_3$). The treated steel sheet was washed with water, and then cathodically treated in an aqueous bath containing 120 to 300 g/l of chromic anhydride ($CrO_3$) and a sulfate or fluoride ion as an adjuvant in an amount corresponding to 1/200 to 1/10 of the concentration of the chromic acid.

(2) The surface of a steel sheet is degreased and washed with an acid and water in a customary manner, and then cathodically treated in an aqueous bath containing 30 to 100 g/l of chromic anhydride ($CrO_3$) and a sulfate or fluoride ion as an adjuvant in an amount corresponding to 1/200 to 1/50 of the concentration of the chromic acid. The treated steel sheet is washed with hot water, and dipped in an aqueous bath containing a copolymer of trans-$\beta$-hydromuconic acid and butadiene.

(3) The surface of a steel sheet is degreased and washed with an acid and water in a customary manner, and then cathodically treated in an aqueous bath containing 30 to 70 g/l of chromic anhydride ($CrO_3$) and a sulfate or fluoride ion as an adjuvant in an amount corresponding to 1/200 to 1/50 of the concentration of the chromic acid. Subsequently, the treated steel sheet is dipped in boiling water, and immediately then, cathodically treated in an aqueous bath containing 150 to 300 g/l of chromic anhydride ($CrO_3$) and a sulfate or fluoride ion as an adjuvant in an amount corresponding to 1/200 to 1/50 of the concentration of the chromic acid.

The electrolytically chromated steel sheets in accordance with this invention preferably have a specified surface characteristic with regard to the amount of electricity flowing therethrough under certain conditions, which is determined in the following manner. A sample of electrolytically chromated steel sheet is dipped in a first electrolytic bath composed of a deionized water solution containing 240 g/l of $NiSO_4.6H\ O$, 45 g/l of $NiCl_2.6H_2O$ and 30 g/l of boric acid and having its pH adjusted to 3.35 electrolytically by using a platinum anode. After a lapse of 3 minutes, the steel sheet is electrolyzed potentiostatically at 0.4 V below the spontaneous electrode potential measured by using a silver-silver chloride reference electrode for 10 seconds using platinum as counter electrodes under the following conditions.

Bath temperature: 50° C.

Interelectrode distance: 5 cm

Available area of each electrode: 1 $cm^2$

The amount of electricity ($Q_1$) which flows through the sample during this time is measured.

The sample is then washed with water and dried, and dipped in a second electrolytic bath composed of a deionized water solution containing 1 mole of $NaH_2PO_4.2H_2O$. After a lapse of 5 minutes, the steel sheet is electrolyzed potentiostatically at 1.6 V above the spontaneous electrode potential measured by using a silver-silver chloride reference electrode for 300 seconds under the following conditions using platinum as counter electrode.

Bath temperature: 25° C.

Interelectrode distance: 5 cm

Available area of each electrode: 1 $cm^2$

The amount of electricity ($Q_2$) which flows through the sample during this time is measured.

Thus, the following relations are established.

$Q_1 < 200$ millicoulombs and $30 < Q_2 < 300$ millicoulombs, especially $Q_1 < 150$ millicoulombs and $50 < Q_2 < 250$ millicoulombs.

The can body of this invention is formed by known techniques for the production of TFS can bodies from the electrolytically chromated steel sheet described hereinabove, which include, for example, a method comprising bonding a side seam portion of can body by means of an adhesive (cemented can), a method comprising welding a side seam portion of can body (welded can), or a method comprising forming a seamless can body by a drawing process (deep-drawn can).

For example, the cemented can is produced by cutting a rectangular sheet of a predetermined dimension from the above-described steel sheet to form a can body blank, applying an adhesive to one or both side margins of the blank which will form a joint of the can body, bending the metal blank into a desired tubular shape such as a circular cylinder, elliptic cylinder or square tube, superimposing the opposing margins of the blank, bonding them to each other to form a can body, and securing a top end to the can body by any known method such as double seaming to form a can.

Examples of the adhesive are nylon 12, nylon 11, nylon 610, and copolymers or blends of these.

The method of producing the aforesaid cemented can and the details of the adhesive are described in Japanese Patent Publications Nos. 18096/73, 37690/76, and 18978/76, and Journal of the Adhesion Society of Japan, Vol. 11, No. 2, pages 84–89, 1975.

The welded can is produced in the same way as in the production of the cemented can except that the marginal portions of the can body blank are superimposed and welded instead of applying an adhesive.

Preferably, prior to fabrication, the steel sheet is coated with an organic enamel. An enamel consisting of epoxy resin and phenol resin, known as enamel for can coating (Journal of The Adhesion Society of Japan Vol. 11, No. 2, page 89, 1975) is an example of preferred organic coating for use in this invention.

When the can body of this invention is used as a lacquered can for heat sterilization, the adhesion of the lacquer film has good resistance to degradation by hot water or with the lapse of time, and can be suitably used for hot filled drinks, carbonated drinks or beer. The side seam of a can body mde of the electrolytically chromated steel sheet of this invention has much better properties, especially resistance to heat degradation, than conventional cans for carbonated drinks or hot-filled juices which are made of electrolytically chromated steel sheets, and exhibits marked advantages. For example, the bonded portion is not peeled off during the heat sterilizing step. The bonded portion does not undergo appreciable degradation with time at the time of heat sterilization, and even when the can is stored for a long period of time, the degree of vacuum in the can does not decrease, and corrosion at the processed part, especially double-seamed portion, and the lifting of the coating does not occur. Moreover, the adhesion strength of the processed portion is not appreciably deteriorated. Accordingly, the can body in accordance with this invention is very good for use in making cemented cans which are to be heat sterilized.

The can body of this invention may be uncoated with enamel when it is intended for general use cans for filling such products as aerosols, paints and confectionary.

The following Examples specifically illustrate the effects of the present invention.

The various tests in the Examples were conducted by the following methods.

(1) Adhesion strength of a bonded portion of the can

The bonded portion is cut out with a width of 7 mm from a cemented can, and subjected to "T-peel" test by a tensile tester, and the strength at this time is measured. By this test, the adhesion of the enamel after bonding is evaluated. The results is expressed as an arithmetic average of the results obtained with 10 sample cans.

(2) Adhesion strength of a bonded portion of the stored can having contents

Contents are filled in a can under ordinary filling conditions, and the can is double seamed. Then, the contents in the can are heat sterilized under prescribed conditions (orange juice is not heat sterilized). The can is then stored at 50° C. for 6 months, and opened. The can body is washed with water and dried. The bonded portion with a width of 7 mm is cut out, and subjected to "T-peel" test by a tensile tester. The strength at this time is measured. The results are shown by an arithmetic average of the results obtained with 10 sample cans.

(3) Number of broken cans during the heat sterilizing step.

One hundred sample cans are filled with contents under ordinary filling conditions, double seamed and heat-sterilized under prescribed conditions. The number of broken cans is counted. (The broken cans refer to those cemented cans in which the side seam portion is peeled off.)

(4) Dissolved iron

The amount (mg) of dissolved iron per 1000 g of the contents is measured on a can stored at 37° C. for 1 year. The results are shown by an arithmetic average of the results obtained with 10 sample cans.

(4) Perforation

Cans are filled with a product under ordinary filling conditions, double seamed, and heat sterilized under prescribed conditions. Then, the cans are stored at 37° C., and the number of cans in which perforations were formed within one year is counted. The total number of sample cans is 100.

(6) Leakage with the lapse of time

The degree of vacuum in the cans used in test (2) above is measured.

(7) State of the inside surface of a can

After opening a sample can, rusting on the inside surface of the can, the deterioration of the coated film, etc. are evaluated visually.

EXAMPLE 1

A cold-rolled steel sheet having a thickness of 0.23 mm was electrolytically degreased in a sodium hydroxide solution, pickled with a sulfuric acid solution having a concentration of 70 g/l and then rinsed. The treated steel sheet was then dipped in a treating bath consisting of chromic anhydride in a concentration of 0.4 g/l under the following conditions.

pH: 2.4

Bath temperature: 50° C.

Treating time: 3 seconds

The steel sheet wash then washed with water, and cathodically treated under the following conditions, rinsed with hot water, and then dried.

| | | |
|---|---|---|
| Treating bath: | Chromic anhydride | 200 g/l |
| | Sulfuric acid | 1.2 g/l |
| | Sodium fluoride | 3.0 g/l |

-continued

| | |
|---|---|
| Bath temperature: | 50° C. |
| Current density | 25 A/dm$^2$ |
| Treating time: | 4 seconds |

The $(O_{P-P})/(Cr_{B-P})$ ratio, the amount of chromium per unit area, and $Q_1$ and $Q_2$ of the resulting chromium-coated steel sheet were measured.

The steel sheet was coated with an enamel consisting of epoxy resin and phenol resin, and a cemented can having an inside diameter of 74 mm and a height of 113.3 mm was produced by using a nylon adhesive. Mackerel was filled in this can, and steam exhausted. Then tomato sauce was added, and the can was double seamed. The can was then heat sterilized at 115° C. for 120 minutes. The cemented can and the filled can were subjected to the various tests indicated in Table 1. The results are shown in Table 1.

EXAMPLE 2

A cold-rolled steel sheet having a thickness of 0.23 mm was pre-treated in the same way as in Example 1, and subjected to spray treatment under the following conditions.

| | |
|---|---|
| Treating solution: | Chromic anhydride 0.2 g/l |
| pH: | 2.7 |
| Solution temperature: | 60° C. |
| Treating time: | 1 second |

The steel sheet was washed with water, and cathodically treated under the following conditions, washed with hot water, and then dried.

| | | |
|---|---|---|
| Treating bath: | Chromic anhydride | 150 g/l |
| | Sulfuric acid | 0.5 g/l |
| | Sodium silicofluoride | 2.0 g/l |
| Bath temperature: | 60° C. | |
| Current density: | 35 A/dm$^2$ | |
| Treating time: | 4 seconds | |

The specific properties of the chromium-coated steel sheet were measured in the same way as in Example 1. Cemented cans were produced from the resulting steel sheet, and subjected to the various tests, in the same way as in Example 1. The results are also shown in Table 1.

EXAMPLE 3

A cold-rolled steel sheet having a thickness of 0.23 mm was pre-treated in the same way as in Example 1, and then cathodically treated under the following conditions.

| | | |
|---|---|---|
| Treating bath: | Chromic anhydride | 80 g/l |
| | Sulfuric acid | 0.3 g/l |
| | Sodium silicofluoride | 1.0 g/l |
| Bath temperature: | 60° C. | |
| Current density: | 30 A/dm$^2$ | |
| Treating time: | 3.5 seconds | |

The electrolytically chromated steel sheet was then washed with hot water, and dipped in a 0.5% aqueous solution of a copolymer of trans-β-hydromuconic acid and butadiene at 50° C. The dipped steel sheet was passed through squeeze rolls, and dried in hot air.

The specific properties of the resulting chromium-coated steel sheet were measured in the same way as in Example 1. Cemented cans were made, and subjected to various tests, in the same way as in Example 1. The results are shown in Table 1.

EXAMPLE 4

A cold-rolled steel sheet having a thickness of 0.23 mm was pre-treated in the same way as in Example 1, and cathodically treated under the following conditions.

| | | |
|---|---|---|
| Treating bath: | Chromic anhydride | 70 g/l |
| | Sulfuric acid | 0.6 g/l |
| Bath temperature: | 50° C. | |
| Current density: | 40 A/dm$^2$ | |
| Treating time: | 1.5 seconds | |

The treated steel sheet was washed with hot water, and dipped in a 0.3% aqueous solution of a copolymer of trans-$\beta$-hydromuconic acid and butadiene at 40° C. The dipped steel sheet was passed through squeeze rolls, and dried in hot air.

The specific properties of the resulting chromium-coated steel sheet were measured in the same way as in Example 1. Cemented cans were made, and subjected to the various tests, in the same way as in Example 1. The results are shown in Table 1.

EXAMPLE 5

A cold-rolled steel sheet having a thickness of 0.23 mm was pre-treated in the same way as in Example 1, and cathodically treated under the following conditions.

| | | |
|---|---|---|
| Treating bath: | Chromic anhydride | 40 g/l |
| | Sulfuric acid | 0.5 g/l |
| Bath temperature: | 40° C. | |
| Current density: | 20 A/dm$^2$ | |
| Treating time: | 2 seconds | |

The treated steel sheet was dipped in boiling water for 5 seconds, and cathodically treated under the following conditions, then washed with hot water and dried.

| | | |
|---|---|---|
| Treating bath: | Chromic anhydride | 200 g/l |
| | Sulfuric acid | 0.05 g/l |
| | Sodium silicofluoride | 2 g/l |
| Bath temperature: | 50° C. | |
| Current density: | 40 A/dm$^2$ | |
| Treating time: | 4 seconds | |

The specific properties of the resulting chromium-coated steel sheet was measured in the same way as in Example 1. Cemented cans were made, and subjected to the various tests, in the same way as in Example 1. The results are shown in Table 1.

Comparative Example 1

The same cold-rolled steel sheet as used in Example 1 was pre-treated in the same way as in Example 1, and then cathodically treated under the following conditions, followed by washing with hot water and dried.

| | | |
|---|---|---|
| Treating bath: | Chromic anhydride | 250 g/l |
| | Sulfuric acid | 2.5 g/l |
| Bath temperature: | 50° C. | |
| Current density: | 20 A/dm$^2$ | |
| Treating time: | 10 seconds | |

The specific properties of the resulting chromium-coated steel sheet were measured in the same way as in Example 1. Cemented cans were produced, and subjected to the various tests, in the same way as in Example 1. The results are shown in Table 1.

Comparative Example 2

The same cold-rolled steel sheet as used in Example 1 was pre-treated in the same way as in Example 1, and cathodically treated under the following conditions, followed by washing with hot water and dried.

| | | |
|---|---|---|
| Treating bath: | Chromic anhydride | 40 g/l |
| | Sulfuric acid | 0.10 g/l |
| | Sodium fluoride | 0.25 g/l |
| Bath temperature: | 55° C. | |
| Current density: | 15 A/dm$^2$ | |
| Treating time: | 10 seconds | |

The specific properties of the resulting chromium-coated steel sheets were measured in the same way as in Example 1. Cemented cans were produced, and subjected to the various tests, in the same way as in Example 1. The results are shown in Table 1.

Comparative Example 3

The same cold-rolled steel sheet as used in Example 1 was pre-treated in the same way as in Example 1. The pre-treated steel sheet was cathodically treated under the following conditions, washed with hot water, and dried.

| | | |
|---|---|---|
| Treating bath: | Chromic anhydride | 40 g/l |
| | Chromium sulfate | 0.5 g/l |
| Bath temperature: | 35° C. | |
| Current density: | 15 A/dm$^2$ | |
| Treating time: | 5 seconds | |

The specific properties of the resulting chromium-coated steel sheet was measured in the same way as in Example 1. Cemented cans were produced, and subjected to the various tests, in the same way as in Example 1. The results are shown in Table 1.

TABLE 1

| Ex. or CEx. (*) | $(O_{P-P})/(Cr_{B-P})$ | $Q_1$ | $Q_2$ | Amount of Cr per unit area ($mg/m^2$) | Adhesion strength of a bonded portion of the can (kg/5mm) | Adhesion strength of a bonded portion of the stored can (kg/5mm) | Number of broken cans in the heat sterilization step | Dissolved iron (ppm) | Perforation | Leakage (cm Hg) | State of the inside surface of a can |
|---|---|---|---|---|---|---|---|---|---|---|---|
| Ex. 1 | 3.2 | 75 | 160 | 85 | 8.6 | 7.7 | 0 | 0.16 | 0 | 23 | No change |
| Ex. 2 | 4.5 | 134 | 138 | 120 | 8.5 | 7.7 | 0 | 0.10 | 0 | 25 | " |
| Ex. 3 | 5.3 | 66 | 86 | 93 | 8.5 | 7.6 | 0 | 0.18 | 0 | 22 | " |
| Ex. 4 | 6.0 | 21 | 50 | 40 | 8.3 | 7.3 | 0 | 0.16 | 0 | 23 | " |
| Ex. 5 | 2.0 | 250 | 260 | 138 | 8.3 | 7.0 | 0 | 0.45 | 0 | 22 | " |
| CEx. 1 | 0.8 | 420 | 535 | 340 | 4.5 | 1.3 | 87 | 12.5 | 25 | 0 | Rust spots on the entire surface of the can body. |
| CEx. 2 | 7.6 | 185 | 230 | 150 | 7.7 | 3.5 | 40 | 4.0 | 5 | 3 | Rust spots on a part of the can body. |
| CEx. 3 | 10.2 | 252 | 405 | 145 | 7.2 | 1.8 | 73 | 8.6 | 16 | 0 | Rust spots on the entire surface of the can body. |

(*) Ex. = Example; CEx. = Comparative Example

EXAMPLE 6

A double reduced steel sheet having a thickness of 0.17 mm was treated in the same way as in Example 1. Then, an enamel consisting of epoxy resin and phenol resin was coated on the steel sheet. By using a nylon adhesive, a cylindrical cemented can body having an inside diameter of 52.3 mm and a height of 133.1 mm was produced. Then, 13 beads were provided in the can body (multibeaded can), and both ends of the can body were subjected to neck-in processing so that each end had a diameter of 50 mm. The resulting cemented can was filled with apple juice at 93° C., and subjected to the same tests as in Example 1. The results are shown in Table 2.

EXAMPLES 7 TO 11

An enamel consisting of epoxy resin and phenol resin was coated on the electrolytically chromated steel sheet produced in Example 1. In Examples 7 and 8, the treated steel sheet was formed into welded cans having an inside diameter of 74.0 mm and a height of 113.2 mm. In Examples 9, 10 and 11, deep-drawn cans having an inside diameter of 83.3 mm and a height of 45.8 mm were produced. Each of the cans was filled with the contents shown in Table 2, heat-sterilized, and subjected to the various tests in the same way as in Example 1. The results are shown in Table 2.

TABLE 2

| Example | Dissolved iron (ppm) | Perforation | Leakage with time (cm Hg) | State of the inside surface of can | Contents of can | Filling conditions or heat-sterilizing conditions |
|---|---|---|---|---|---|---|
| 6 | 0.25 | 0 | 28 | No change | Apple juice | Filled at 93° C. |
| 7 | 0.10 | 0 | 20 | " | Luncheon meat | Sterilized at 115° C. for 120 minutes |
| 8 | 0.16 | 0 | 25 | " | Mackerel in tomato sauce | Sterilized at 115° C. for 120 minutes |
| 9 | 0.17 | 0 | 21 | " | Salmon in brine | Sterilized at 115° C. for 90 minutes |
| 10 | 0.11 | 0 | 20 | " | Luncheon meat | Sterilized at 115° C. for 90 minutes |
| 11 | 0.20 | 0 | 21 | " | Tuna in tomato dressing | Sterilized at 115° C. for 90 minutes |

It is seen from Example 1 to 5 that cemented cans produced from electrolytically chromated steel sheets having a $(O_{P-P})/(Cr_{B-P})$ ratio of from 1.5 to 6.5, $Q_1$ of less than 200 millicoulombs and $Q_2$ of from 30 to 300 millicoulombs give excellent results in the adhesion strength of bonded portion of the can, the adhesion strength of a bonded portion of the filled and stored can, resistance to heat sterilization, dissolved iron, leakage and the state of the inside of a can, irrespective of the amount of chromium per unit area.

It is clearly seen from Examples 6 to 11 that multibead cemented cans, welded cans and deep-drawn cans produced from the electrolytically chromated steel sheet of this invention give very good results in all of the items tested.

What we claim is:

1. A can at least a part of which is made of an electrolytically chromated steel sheet having a chromium-containing surface layer consisting of a layer of metallic chromium and a layer of chromium oxide, the thickness of the metallic chromium layer being from 20 to 300 $mg/m^2$ and the thickness of the chromium oxide layer being 5 to 50 $mg/m^2$ based on the amount of chromium, said steel sheet having a surface such that when it is degreased in acetone for 1 minute and analyzed by an Auger electron spectrometer at an incident electron accelerating voltage of 3 KeV, a modulation voltage of 3 V, a modulation frequency of 12 to 20 KHz and a degree of vacuum of at least $6\times10^{-8}$ torr, the ratio of the peak-peak distance ($O_{P\text{-}P}$) of $KL_{2.3}L_{2.3}$ of oxygen to the base-peak distance ($Cr_{B\text{-}P}$) of $L_3M_{2.3}M_{4.5}$ of chromium in the resulting Auger electron spectrum satisfies the following relation:

$$6.5 \geqq (O_{P\text{-}P})/(Cr_{B\text{-}P}) \geqq 1.5.$$

2. The can of claim 1 wherein the electrolytically chromated steel sheet satisfies the following relation:

$Q_1 < 200$ millicoulombs and $30 < Q_2 < 300$ millicoulombs in which $Q_1$ is the amount of electricity which passes through the surface of electrolytically chromated steel sheet when it is dipped in a first electrolytic bath consisting of a deionized water solution containing 240 g/l of $NiSO_4.6H\ O$, 45 g/l of $NiCl_2.6H\ O$ and 30 g/l of boric acid and having its pH adjusted electrolytically to 3.35 using a platinum anode and after a lapse of 3 minutes, electrolyzed potentiostatically at 0.4 V below the spontaneous electrode potential measured by using a silver-silver chloride reference electrode for 10 seconds using platinum as counter electrode, while maintaining the bath temperature at 50° C., the interelectrode distance at 5 cm, and the available area of each electrode at 1 $cm^2$; and in which $Q_2$ is the amount of electricity which passes through the surface of the electrolytically chromated steel sheet when the sample after the measurement of $Q_1$ is washed with water, dried, dipped in a second electrolytic bath composed of a deionized water solution containing 1 mole of $NaH_2PO_4.2H_2O$, and after a lapse of 5 minutes, electrolyzed potentiostatically at 1.6 V above the spontaneous electrode potential measured by using a silver-silver chloride reference electrode for 300 seconds using platinum as counter electrode while maintaining the bath temperature at 25° C., the interelectrode distance at 5 cm, and the available area of each electrode at 1 $cm^2$.

3. The can of claim 2 or 1 which is coated with an organic coating.

4. The can of claim 3 wherein the organic coating is an enamel consisting of epoxy resin and phenol resin.

* * * * *